US005297506A

United States Patent [19]

Reckzügel et al.

[11] Patent Number: 5,297,506

[45] Date of Patent: Mar. 29, 1994

[54] VALVE OPERATING SYSTEM FOR AN INTERNAL COMBUSTION ENGINE

[75] Inventors: Christoph Reckzügel, Stuttgart; Mario Mürwald, Ebersbach; Gerhard Doll, Stuttgart; Ralf Ohlendorf, Weinstadt, all of Fed. Rep. of Germany

[73] Assignee: Mercedes-Benz A.G., Stuttgart, Fed. Rep. of Germany

[21] Appl. No.: 105,124

[22] Filed: Aug. 12, 1993

[30] Foreign Application Priority Data

Aug. 20, 1992 [DE] Fed. Rep. of Germany ..... 4227567

[51] Int. Cl.[5] ..... F01L 1/34; F01L 1/18

[52] U.S. Cl. ..... 123/90.16; 123/90.27; 123/90.38; 123/90.44

[58] Field of Search ..... 123/90.16, 90.27, 90.38, 123/90.39, 90.41, 90.44, 193.5

[56] References Cited

U.S. PATENT DOCUMENTS

| | | | |
|---|---|---|---|
| 4,438,734 | 3/1984 | Hayashi et al. | 123/90.27 |
| 4,768,467 | 9/1988 | Yamada et al. | 123/90.16 |
| 4,883,027 | 11/1989 | Oikawa et al. | 123/90.16 |
| 4,887,563 | 12/1989 | Abushi et al. | 123/90.16 |
| 4,907,550 | 3/1990 | Abushi et al. | 123/90.16 |
| 5,052,351 | 10/1991 | Nishimura et al. | 123/90.38 |
| 5,080,054 | 1/1992 | Nakamura | 123/90.16 |
| 5,095,859 | 3/1992 | Iwata et al. | 123/90.16 |
| 5,150,675 | 9/1992 | Murata | 123/90.38 |
| 5,186,128 | 2/1993 | Murata et al. | 123/90.16 |
| 5,207,193 | 5/1993 | Sugimoto et al. | 123/90.16 |

OTHER PUBLICATIONS

Honda Publication, CIVIC, Technology and Data, List 4 p. 8, as of Aug. 1991, "Design of a Value Operating System".

*Primary Examiner*—Raymond A. Nelli
*Assistant Examiner*—Weilun Lo
*Attorney, Agent, or Firm*—Klaus J. Bach

[57] ABSTRACT

In a valve operating system for an internal combustion engine with overhead valves and a camshaft supported by a bearing bracket mounted on the cylinder head for the actuation of the valves via a rocker arm arrangement comprising for at least one of the valves a main rocker arm and adjacent thereto an auxiliary rocker arm adapted to be coupled to the main rocker arm for superimposing its movement as controlled by its associated cam structure onto the main rocker arm which operates the associated valve, a spring supporting element which engages the auxiliary rocker arm so as to maintain it in contact with the associated cam structure engages with its one end the auxiliary rocker arm and is supported with its other end on said bearing bracket.

5 Claims, 2 Drawing Sheets

VALVE OPERATING SYSTEM FOR AN INTERNAL COMBUSTION ENGINE

BACKGROUND OF THE INVENTION

The invention relates to a valve operating system for a multi-cylinder internal combustion engine with at least one intake and exhaust valve per cylinder, with a camshaft, having cams and being supported in bearing brackets mounted on the cylinder head, for the actuation of the valves via a rocker lever arrangement.

U.S. Pat. No. 4,438,734, for example, discloses an internal combustion engine with an overhead camshaft which operates the cylinder valves via rocker arms all supported by bearing support structures which are interconnected by an integral connecting structure.

The related U.S. Pat. Nos. 4,887,563 and 4,907,550 show a valve actuating structure for an internal combustion engine with overhead valves operated by an overhead camshaft via a rocker arm arrangement which includes for one valve two parallel rocker arms, a main rocker arm and an auxiliary rocker arm which are actuated by different cams, a main cam actuating the valve and providing appropriate valve timing for relatively low engine speed and an auxiliary cam actuating the auxiliary rocker arm and providing appropriate valve timing for high engine speeds. By pressurized oil supplied through passages in the rocker arm support shaft the auxiliary rocker arms are coupled with the main rocker arms during high engine speeds so that the valve timing of the auxiliary rocker arms is superimposed on the main rocker arms. The auxiliary rocker arms are held in contact with the cams via a spring structure disposed below the auxiliary rocker arm, that is, between the auxiliary rocker arm and the engine cylinder head.

The Honda publication, CIVIC, Technology and Data, List 4, Page 8, as of August, 1991, "design of a valve operating system", describes a valve operating system with a spring support element disposed between the upper side of an auxiliary rocker arm and the cylinder head cover and presses the auxiliary rocker arm against an associated cam of the camshaft in order to keep the auxiliary rocker arm in contact with the associated cam when the auxiliary rocker arm is decoupled from the main rocker arm.

The object of the present invention is to provide a considerably more compact valve operating system which facilitates assembly of the valve operating mechanism.

SUMMARY OF THE INVENTION

In a valve operating system for an internal combustion engine with overhead valves and a camshaft supported by a bearing bracket mounted on the cylinder head for the actuation of the valves via a rocker arm arrangement comprising for at least one of the valves a main rocker arm and adjacent thereto an auxiliary rocker arm adapted to be coupled to the main rocker arm for superimposing its movement as controlled by its associated cam structure onto the main rocker arm which operates the associated valve, a spring supporting element which engages the auxiliary rocker arm so as to maintain it in contact with the associated cam structure engages with its one end the auxiliary rocker arm and is supported with its other end on said bearing bracket.

The special way in which the spring supporting element is positioned between the underside of the auxiliary rocker arm and a bearing bracket supported on the cylinder head results in a compact, low-rise design for the valve operating system. The spring supporting element is thus situated within a curve enveloping the rocker arms and the bearing bracket. The cylinder head cover can be designed so as to extend over all the rocker arms with only a small clearance.

In addition, particularly in the case of embodiments of bearing brackets which are a combination of at least two bearing covers and connecting webs connecting these bearing covers so as to form an integral bridge structure, complete preassembly of the rocker arm arrangement with the supporting elements can be carried out and the bridge structure can be mounted to the cylinder head as a complete unit including all the valve operating elements.

DESCRIPTION OF THE PREFERRED EMBODIMENT

Figure 1:
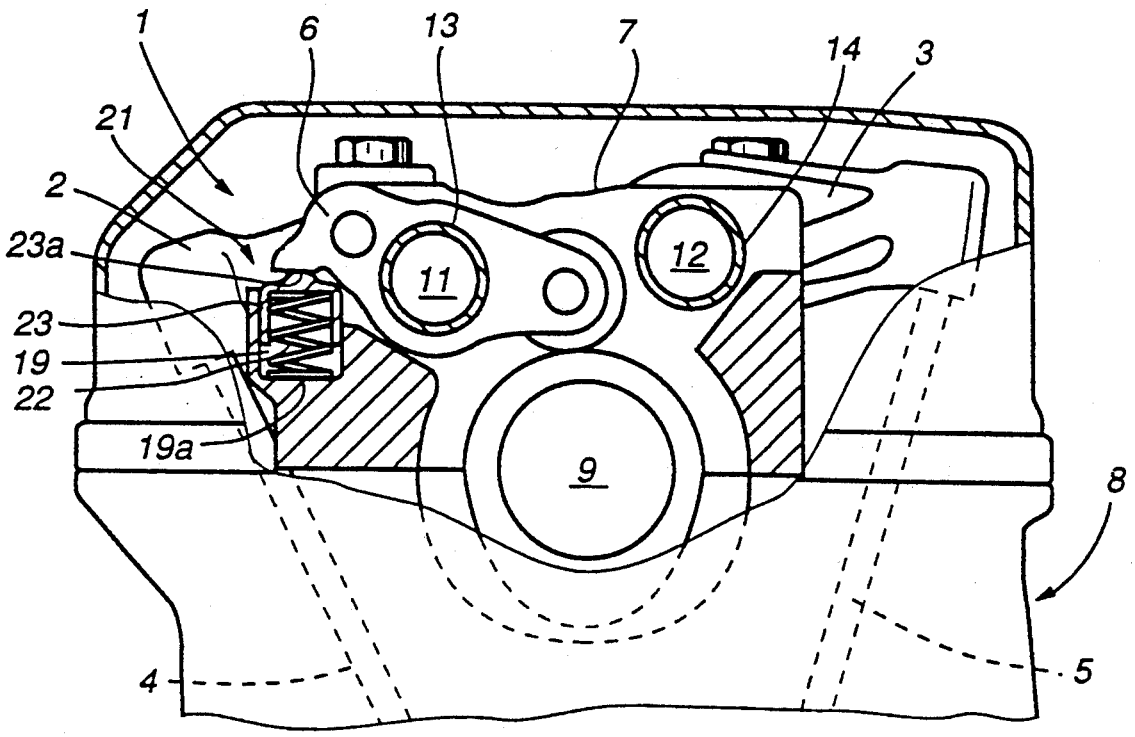
FIG. 1 shows an arrangement with a resilient supporting element integrated into a bearing bracket and interacting with a coupling arm.

A valve operating system 1 for a multi-cylinder internal combustion engine is provided with a valve actuating rocker arm arrangement for each cylinder consisting of main rocker arms 2, 3 for at least one intake and exhaust valve 4 and 5 and of at least one coupling auxiliary rocker arm 6 disposed adjacent the main rocker arm and adapted to be coupled therewith. All the rocker arms 2, 3, 6 are actuated by separate cams of a camshaft 9 which is supported halfway in a bearing bracket 7 and halfway in the cylinder head 8. The bearing bracket 7 is bolted to the cylinder head 8 and either forms a one-piece bearing cap or comprises at least two bearing caps 9, 10 with bearing holes 11, 12 for the mounting of rocker arm support shafts 13, 14 and includes connecting webs 15, 16 connecting the bearing caps 9, 10 to one another. In accordance with FIG. 3, the two bearing caps 9, 10 and the two connecting webs 15, 16 are combined to form an integral bridged bearing cap and support structure.

Figure 3:
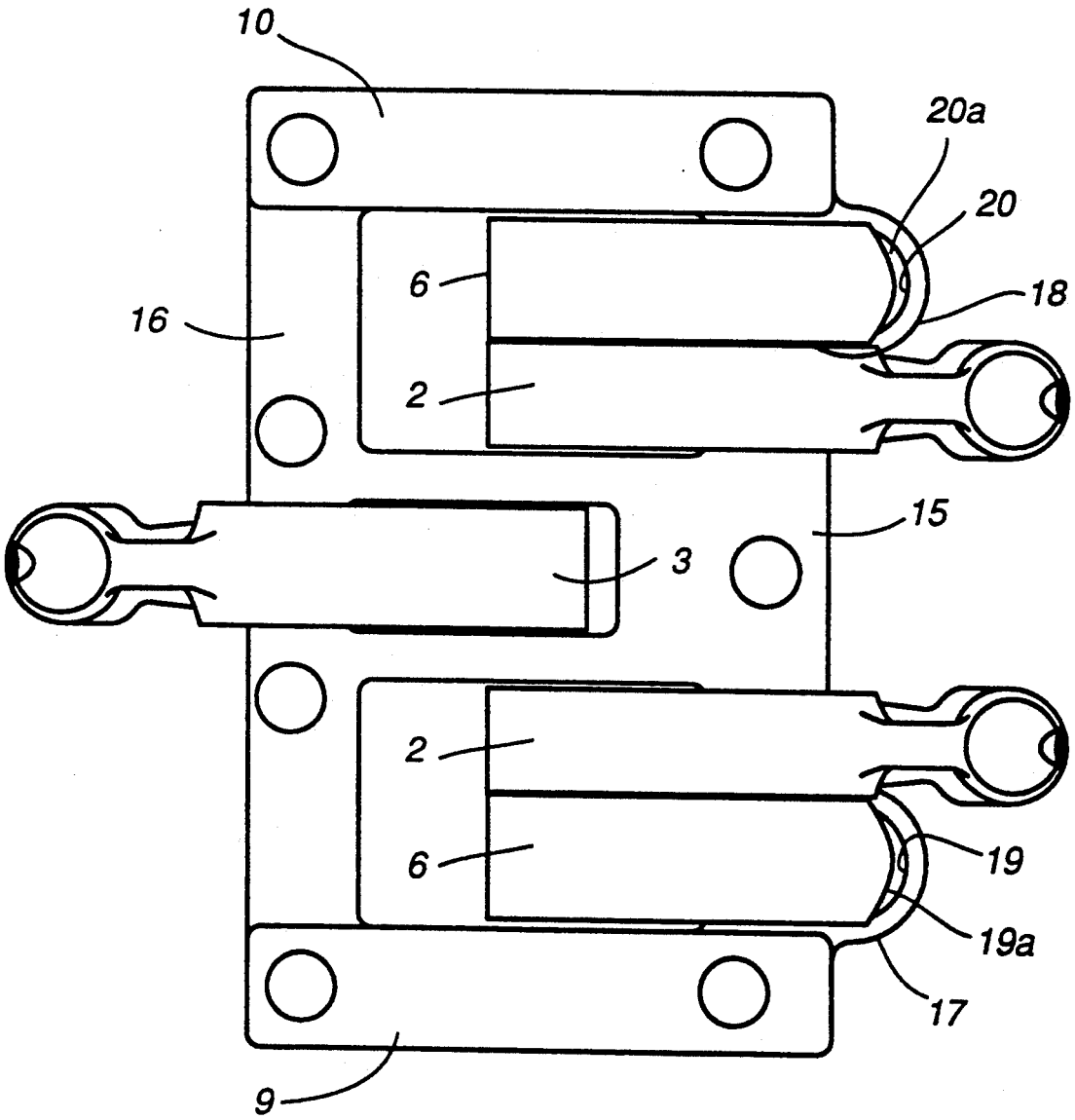
FIG. 3 shows the bearing bracket according to FIG. 1 in plan view.

Formed integrally with the connecting web 15, immediately next to each bearing cap 9, 10, is a support structure 17, 18 which, according to FIGS. 1 and 3, has a cylindrical recess 19, 20 for the accommodation of a supporting element 21, which comprises a compression spring 22 and a guiding cup 23 which surrounds the latter and is guided in longitudinally displaceable fashion in the recess. The compression spring 22 is supported at one end against the base **19*a*, 20*a* of the recess 19, 20 and, at the other end, via the guiding cup 23, against the auxiliary rocker arm 6, which, at its free end remote from the camshaft 9, has a sliding surface 6*a* on the underside for the spherically shaped base 23*a* of the guiding cup 23**.

Figure 2:
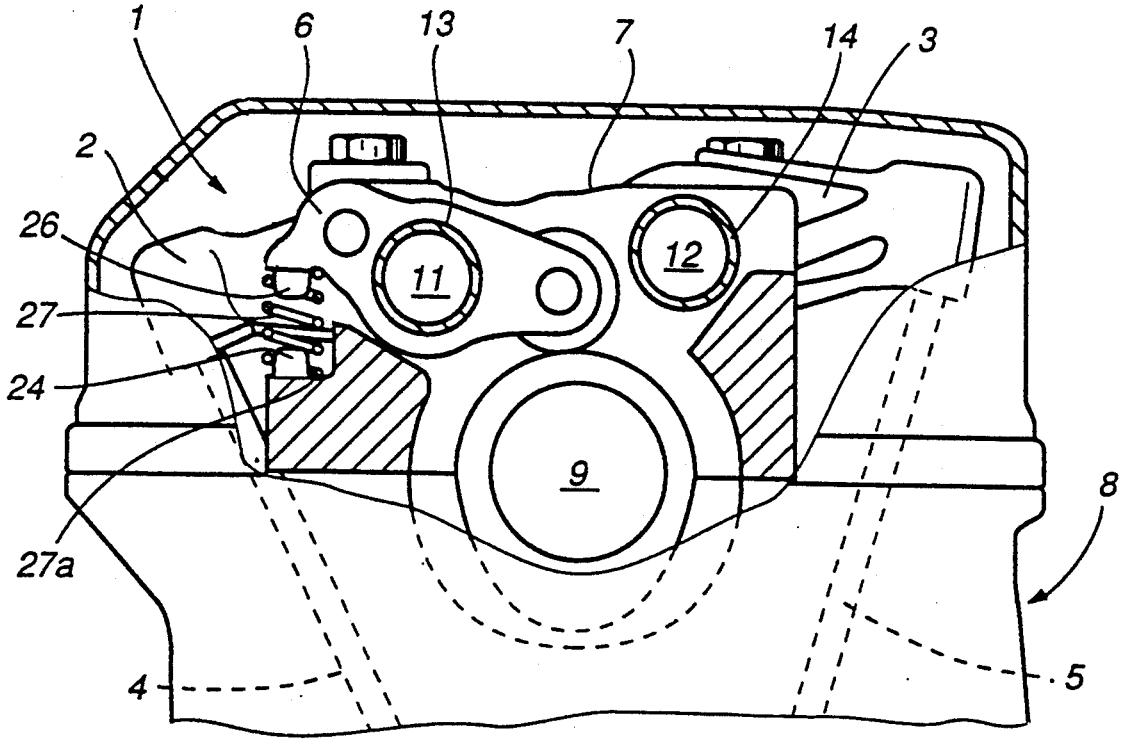
FIG. 2 shows another embodiment of the supporting element on the bearing bracket.

In FIG. 2, an upward-projecting guide pin 24 is provided on the connecting web 15 instead of a cylindrical recess 19, 20 and, together with a guide pin 26 projecting downwards from the underside of the auxiliary rocker arm 6, serves as a guide or position-fixing device for the compression spring 27 positioned between them.

It is noted that the main rocker arm and the adjacent auxiliary rocker arm are operated independently by different cam structures, the main rocker arm, for example, by a cam structure providing valve timing appropriate for a relatively low engine RPM range and the auxiliary rocker arm by a cam structure for extended valve opening periods as they are appropriate for high engine speeds. The auxiliary rocker arm is idle at lower engine speeds but is coupled with the main rocker arm at higher engine speeds so that, at higher engine speeds, the valve timing is controlled by the auxiliary rocker arm cam structure. The compact spring support arrangement for the auxiliary rocker arm according to the invention is simple and allows for low engine height and for preassembly of the rocker arms and support springs on the camshaft bearing cover structure thereby substantially reducing engine assembly times and costs.

What is claimed is:

1. A valve operating system for an internal combustion engine having a cylinder head with at least one intake and exhaust valve per cylinder, with a camshaft having cams and being supported in a bearing bracket mounted on the cylinder head, for the actuation of said intake and exhaust valves via a rocker arm arrangement which, for at least one of said intake and exhaust valves, comprises a main rocker arm and an auxiliary rocker arm adapted to be coupled with said main rocker arm, and a spring support element engaging said auxiliary rocker arm so as to maintain it in contact with its associated cam structure, said spring supporting element having one end engaging the underside of said auxiliary rocker arm and an opposite end of said spring supporting element engaging said bearing bracket.

2. A valve operating system according to claim 1, wherein said spring support element comprises a compression spring and a guiding cup which surrounds said compression spring and is guided in a longitudinally displaceable manner in a cylindrical recess formed in said bearing bracket.

3. A valve operating system according to claim 2, wherein said guiding cup has a spherically shaped contact surface abutting said auxiliary rocker arm.

4. A valve operating system according to claim 1, wherein said spring supporting element is a compression spring which is fixed in position by guide pins located on said bearing bracket and on said auxiliary rocker arm and projecting into the ends of said compression spring.

5. A valve operating system according to claim 1, wherein said bearing bracket comprises at least two bearing caps and connecting webs interconnecting said bearing caps so as to form an integral bridge support structure, at least one of said connecting webs having a recess integrally formed therein for receiving and supporting said spring supporting element.

* * * * *